US011841131B2

(12) United States Patent
McDonald

(10) Patent No.: US 11,841,131 B2
(45) Date of Patent: Dec. 12, 2023

(54) JOINT ASSEMBLY FOR LUMINAIRES

(71) Applicant: LMPG Inc., Longueuil (CA)

(72) Inventor: Christopher Cameron McDonald, Burnaby (CA)

(73) Assignee: LMPG INC., Longueuil (CA)

( * ) Notice: Subject to any disclaimer, the term of this patent is extended or adjusted under 35 U.S.C. 154(b) by 0 days.

(21) Appl. No.: 18/121,888

(22) Filed: Mar. 15, 2023

(65) Prior Publication Data

US 2023/0313979 A1 Oct. 5, 2023

Related U.S. Application Data

(60) Provisional application No. 63/324,832, filed on Mar. 29, 2022.

(51) Int. Cl.

| | |
|---|---|
| ***F21V 21/26*** | (2006.01) |
| ***F21V 23/06*** | (2006.01) |
| ***F21S 8/06*** | (2006.01) |
| ***F21V 17/06*** | (2006.01) |

(52) U.S. Cl.

CPC ..... *F21V 21/26* (2013.01); *F21S 8/06* (2013.01); *F21V 17/06* (2013.01); *F21V 23/06* (2013.01)

(58) Field of Classification Search

CPC ..... F21V 21/26; F21V 23/06

See application file for complete search history.

(56) References Cited

U.S. PATENT DOCUMENTS

| | | | | |
|---|---|---|---|---|
| 3,842,386 | A * | 10/1974 | Suska | E05D 11/0081 439/31 |
| 4,412,711 | A * | 11/1983 | Suska | H01R 35/02 439/31 |
| 5,586,895 | A * | 12/1996 | Zehrung | E05D 11/0081 439/165 |
| 9,115,518 | B2 * | 8/2015 | Herglotz | E05D 7/00 |
| 2009/0168422 | A1 | 7/2009 | Chiu et al. | |
| 2020/0284412 | A1 * | 9/2020 | Deakins | F21V 21/108 |

FOREIGN PATENT DOCUMENTS

KR 100988830 B1 10/2010

* cited by examiner

*Primary Examiner* — Evan P Dzierzynski

(74) *Attorney, Agent, or Firm* — Oyen Wiggs Green & Mutala LLP

(57) ABSTRACT

A joint assembly for luminaires is provided. The joint assembly includes a pin having at least one pin section with an upper opening, a side opening, and a bore connecting the upper opening and the side opening. The upper opening is configured to receive at least one power cable to feed through the bore and out the side opening. The joint assembly also includes a primary hinge having a primary vertical base and a plurality of primary knuckles extending from the vertical base, wherein a distal portion of the knuckles has a hole for engaging the pin. The joint assembly also includes at least one secondary hinge having a secondary vertical base and a plurality of secondary knuckles extending from the vertical base, wherein a distal portion of the knuckles has a hole for engaging the pin.

17 Claims, 15 Drawing Sheets

100
20E
20D 100
20E
20D 100
10
20E
20D 100
200
20D
20E
100
200

100
20D
20E 100
20E
20D 20A
20C
20B
20D
20E

100

JOINT ASSEMBLY FOR LUMINAIRES

REFERENCE TO RELATED APPLICATIONS

This application claims the benefit of US provisional patent application No. 63/324,832 filed 29 Mar. 2022, the entirety of which is incorporated by reference herein for all purposes.

TECHNICAL FIELD

The present invention relates to luminaires suspended from the ceiling. In particular, the invention relates to a joint assembly for supplying power to and connecting multiple luminaires.

BACKGROUND

Suspended luminaries are often found in commercial, public and retail spaces. Typically, each luminaire is suspended from the ceiling separately and power is supplied to each luminaire separately. Multiple suspended luminaires can mean multiple suspension cables and multiple power drops which complicates installation and reduces aesthetic appeal. Also, the arrangement and orientation of the luminaires typically have to be predetermined before installation since afterward the luminaires is usually fixed in position. This problem is compounded by the fact that the need for adjustments may only become apparent after installation.

There is a general desire to connect multiple suspended luminaires while minimizing the number of power drops. There is also a general desire to efficiently provide adjustable arrangements and orientations with multiple luminaires.

SUMMARY

The present invention comprises several aspects.

According to one aspect, a joint assembly for luminaires is provided. The joint assembly includes a pin comprising at least one pin section, each pin section having an upper opening, a side opening, and a bore connecting the upper opening and the side opening. The upper opening is configured to receive at least one power cable to feed through the bore and out the side opening. The joint assembly also includes a primary hinge having a primary vertical base for connecting to a luminaire or wall, a plurality of primary knuckles extending from the vertical base, wherein a distal portion of the knuckles including pin engagement means. The joint assembly further includes at least one secondary hinge having a secondary vertical base for connecting to an additional luminaire, and a plurality of secondary knuckles extending from the vertical base, wherein a distal portion of the knuckles includes pin engagement means for engaging the pin.

The primary hinge, the at least one secondary hinge, or both, may be rotatably coupled to the pin.

The primary knuckles and secondary knuckles may interleave.

The side openings of the pin section may horizontally align with gaps between the plurality of primary knuckles.

The at least one secondary hinge may include a through-hole extending through the secondary vertical base to receive the at least one power cable from a corresponding side opening of the pin to feed to a luminaire connectable to the at least one secondary hinge.

The through-hole and the corresponding side opening may be horizontally aligned.

The through-hole may extend at least partially through at least one of the plurality of secondary knuckles.

The through-hole may open at the hole of the at least one of the plurality of secondary knuckles.

An upper portion of the primary hinge may comprise at least one vertical power cable channel and at least one horizontal power cable channel.

The upper portion may comprise two horizontal power cable channels.

The side opening may comprise an outwardly and downwardly tapered lower surface.

The pin may comprise two or more pin sections, wherein the pin sections are stacked to define the pin.

The pin sections may be rotatable with respect to each other.

The pin may be cylindrical.

Each of the primary hinge and the at least one secondary hinges may include a bracket for connecting the primary and secondary vertical bases to corresponding luminaires.

The pin engagement means may include a hole in the distal portion of the knuckles.

The joint assembly may have one, two or three secondary hinges.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

The present invention discloses a joint assembly for connecting multiple luminaires, such as multiple suspended luminaires. The joint assembly is configured for a single power cable to power multiple connected luminaires while providing easy adjustment of the arrangement and orientation of luminaires, and simplified installation of the luminaires. Aspects of the invention provide a joint assembly having a hollow pin for receiving and distributing a power cable to multiple hinges which couple to the pin and connect to individual luminaires and allowing mostly free, or free, rotation about the pin.

FIGS. 1 to 7 and 11A to 11J show a joint assembly 100 according to an embodiment. Joint assembly 100 connects four luminaires L.

A primary power cable 20 is fed through joint assembly 100 and distributed to power four luminaires L. Primary power cable 20 may for example come from the ceiling or from one of the luminaires L from an adjacent joint assembly through an adjacently connected luminaire. Primary power cable 20 may for example be one or more multiple conductor cables, multiple single conductor cables, or any other suitable means for supplying power to multiple luminaires. If primary power cable 20 is coming directly from the ceiling then it may also function as a suspension cable for supporting joint assembly 100 and the suspended luminaires connected thereto, to obviate the need for a separate suspension cable.

Figure 1:
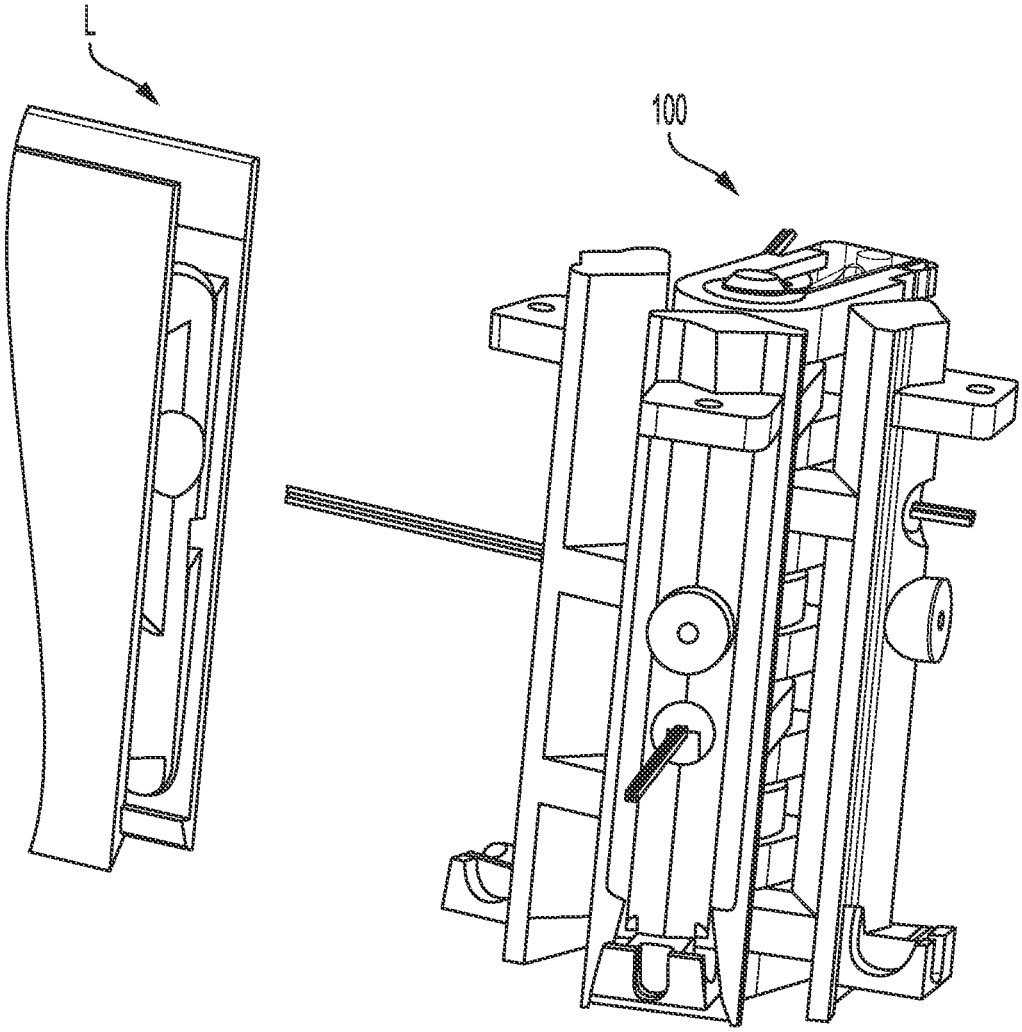
FIG. 1 is a perspective view of a joint assembly according to an embodiment, shown with a luminaire.
Figure 1C:
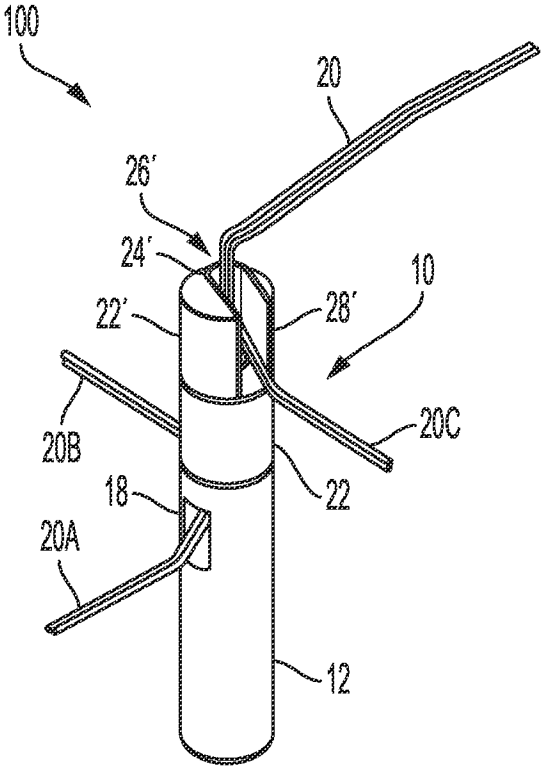
FIG. 1C is a partial perspective view of the joint assembly shown in of FIG. 1, showing a pin base section connected to two pin secondary sections.

FIG. 1 shows joint assembly in a substantially assembled form and a luminaire L. FIGS. 1A to 10 best show a pin 10 of joint assembly 100 (pin 10 is obscured from view in FIG. 1). Pin 10 includes a base section 12 and two secondary sections 18 sequentially stacked on top of base section 12. The shape of the tops of base section 12 and secondary sections 18 may be frustoconical, and the bottoms of secondary sections 18 may be a corresponding concave shape to facilitate engagement between the pin sections. In some embodiments the sections may be detachably connected. In some embodiments, the sections may be fixedly connected once initially connected. Base section 12 and secondary sections 18 are rotatably coupled such that each section can rotate independently of another. In some embodiments the sections may not be rotatable with respect to each other.

Base section 12 has an upper opening 14, a bore 16 connected to upper opening 14, and a side opening 18 connected to bore 16. Each secondary section 22, 22' has an upper opening 24, 24' a bore 26, 26' connected to upper opening 24, 24', and a side opening 28, 28' connected to bore 26, 26'. Side opening 28, 28' may be a slot continuous with bore 26, 26' as best shown in FIG. 10. Bore 16 of base section 12 axially aligns with bores 26, 26' of secondary sections 22, 22'.

Figure 1B:
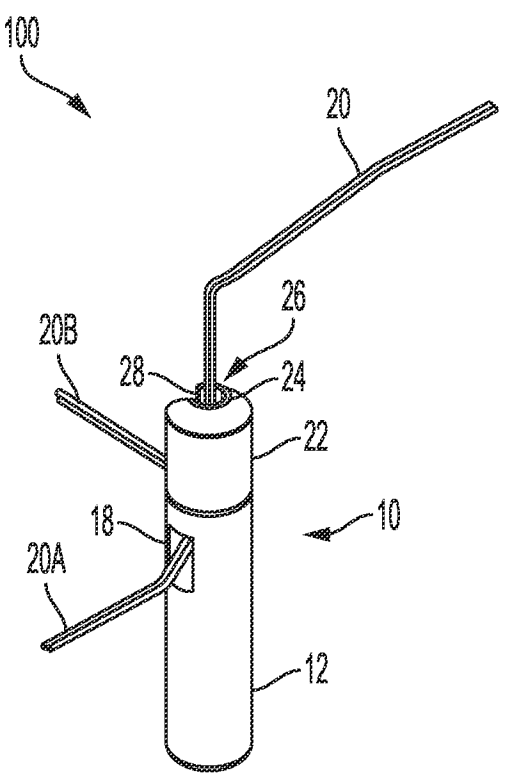
FIG. 1B is a partial perspective view of the joint assembly shown in FIG. 1, showing a pin base section connected to a pin secondary section.
Figure 1A:
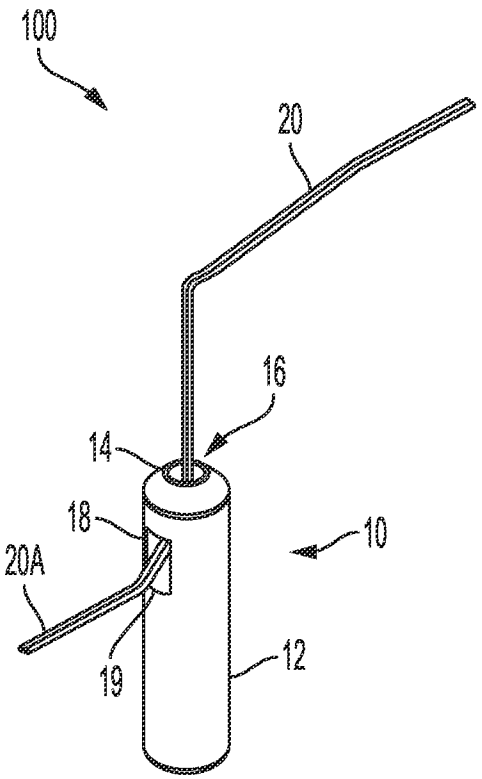
FIG. 1A is a partial perspective view of the joint assembly shown in FIG. 1, showing a pin base section.

With reference to FIG. 1A, power cable 20A is split from primary power cable 20 and is fed into top opening 14, through bore 16, and out side opening 18 for connection to a luminaire L corresponding to base section 12. Side opening 18 may have an outwardly and downwardly tapering lower surface 19 to facilitate feeding and extending of power cable 20A therethrough.

With reference to FIG. 1B, after secondary section 22 is connected to base section 12, a power cable 20B is split from primary power cable 20 and extends through upper opening 24, bore 26 and out side opening 28 for connection to a luminaire L corresponding to secondary section 22.

With reference to FIG. 10, after secondary section 22' is connected to secondary section 22, a power cable 20C split from primary power cable 20 extends through upper opening 24', bore 26' and out side opening 28' for connection to a luminaire L corresponding to secondary section 22'.

As an alternative to the sequence set out in FIGS. 1A to 10, in some embodiments base section 12 and secondary sections 22 of pin 10 may be assembled first, and then respective power cables 20A, 20B, 20C fed through their respective side openings 18, 28, 28'.

In some embodiments side openings 28, 28' may be slots that extend up to a height of secondary sections 22, 22' to facilitate the splitting off and feeding through of power cables 20B, 20C.

As shown in FIGS. 1A to 10, upper openings 14, 24, 24' and bores 16, 26, 26' of base section 12 and secondary sections 22 are vertically aligned when assembled to form pin 10. The height of secondary sections 22,22' may be less than the height of base section 12. The circumference of secondary sections 22,22' and base section 12' may be substantially the same.

Figure 2B:
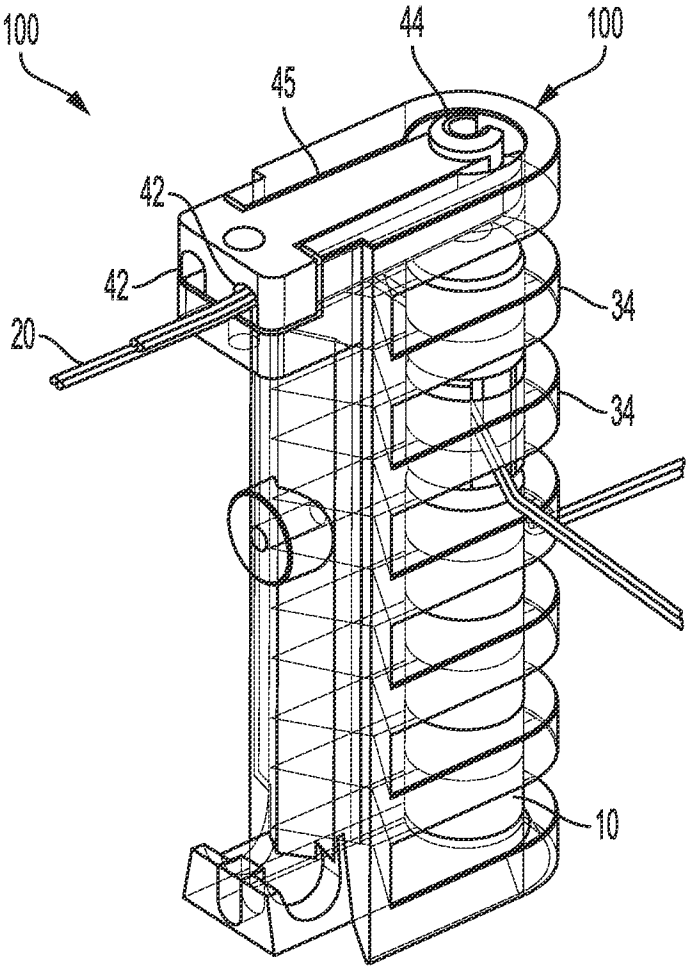
FIG. 2B is a partially transparent partial perspective view of the joint assembly shown in FIG. 1, showing a primary hinge coupled to a pin and a cord suspension slider.
Figure 2A:
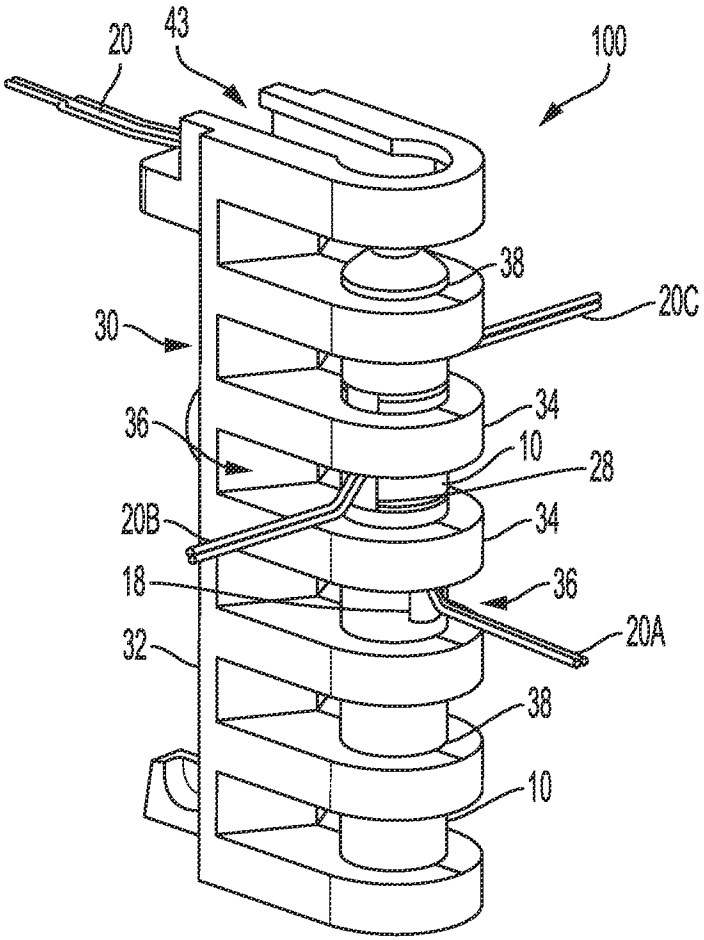
FIG. 2A is a partial perspective view of the joint assembly shown in FIG. 1, showing a primary hinge coupled to a pin.

FIGS. 2A and 2B show pin 10 and a primary hinge 30 of joint assembly 100, and in particular the coupling of these two components. Primary hinge 30 includes a vertical base 32 from which a plurality of vertically spaced apart primary knuckles 34 extend. Primary knuckles 34 are spaced apart by gaps 36. In some embodiments the thickness of primary knuckles 34 and the height of gaps 36 may be substantially similar.

Distal portions of primary knuckles 32 are configured to engage pin 10. As shown in FIGS. 2A and 2B, distal portions of primary knuckles 32 comprise vertically aligned holes 38 through which pin 10 extends. The shape of holes 38 corresponds to the horizontal cross-section of pin 10. Here, pin 10 is cylindrical and holes 36 are circular.

Primary knuckles 34 and gaps 36 are spaced such that side openings 18, 28 of pin 10 correspond to the location of gaps 36 to allow unimpeded extension of power cables 20A, 20B, 20C out of primary hinge 30 into secondary hinges 46, 46', 46" for connecting to their respective luminaires L as described herein.

Figure 3:
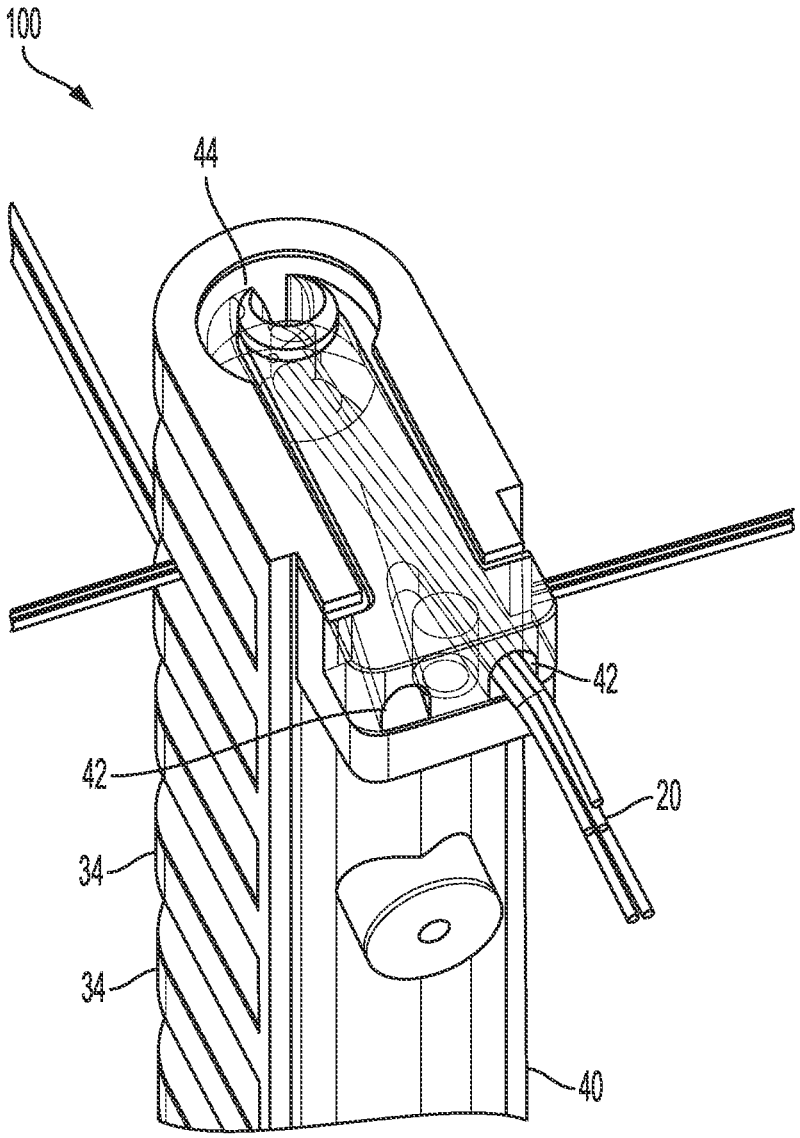
FIG. 3 is an enlarged partial top perspective view of the joint assembly t shown in FIG. 1, showing a primary hinge and a cord suspension slider.

FIGS. 2B and 3 also show that an upper portion of primary hinge 30 includes two horizontal power cable channels 42 connected to a vertical power cable channel 44 for receiving, feeding and/or separating primary power cable 20. Horizontal power cable channels 42 and vertical power cable channel 44 may be part of a cord suspension slider that slidably engageable in slot 43 defined in an upper portion of primary hinge 30. Thus power and suspension cables can thus be easily extended into and out of primary hinge 30 through slot 43, and once they are positioned then cord suspension slider can be slid into slot 43, constraining movement of, and protecting, the power and suspension cables.

In some embodiments vertical power cable channel 44 may be axially aligned with upper openings 14, 24 and bores 16, 26 of base section 12 and secondary sections 22 of pin 10. In some embodiments vertical power cable channel 44 may receive a primary power cable 20 from the ceiling to supply power to the luminaires (and to suspend) luminaires L through joint assembly 100; in this case primary power cable 20 may then split off as power cable 20D through one of horizontal power cable channels 42 to provide power to a luminaire L connected to primary hinge 30; the remainder of primary power cable 20 may be distributed as power cables 20A, 20B, and 20C as described above.

Figures 11A, 11B, 11C, 11D, 11E, 11F, 11G, 11H:
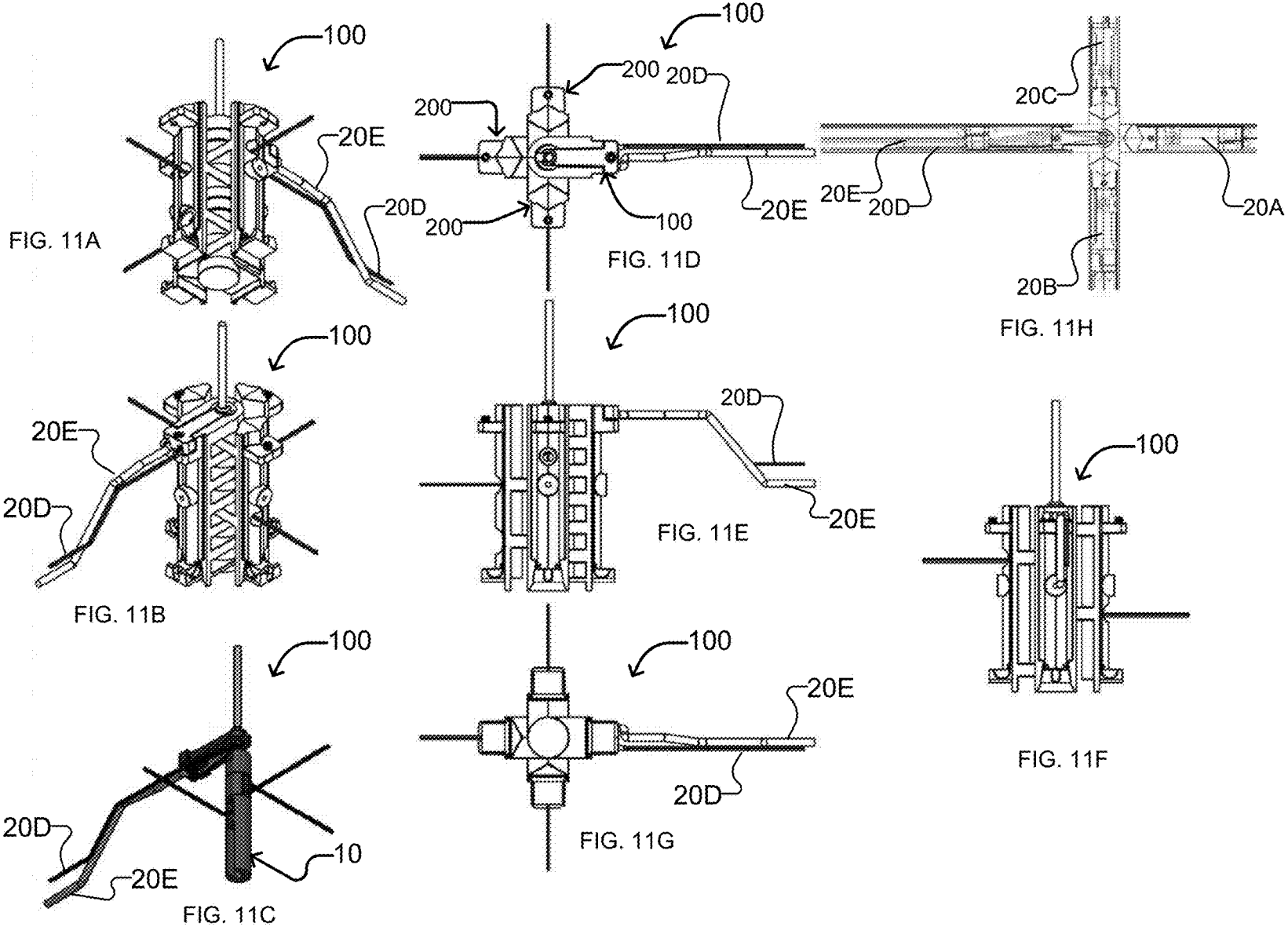
FIG. 11A is a lower perspective view of the joint assembly shown in FIG. 1A.
FIG. 11B is an upper perspective view of the joint assembly shown in FIG. 1A.
FIG. 11C is a partial lower perspective view of the joint assembly shown in FIG. 1A, showing a pin.
FIGS. 11D, 11E, 11F, and 11G are respectively top, side, front and bottom views of the joint assembly shown in FIG. 1A.
FIG. 11H is a partial horizontal cross-sectional view of the joint assembly shown in FIG. 1A coupled to four luminaires.

In addition to primary power cable 20 supplying power to luminaires L of joint assembly 100, primary power cables 20 may split off into power cable 20E for powering other luminaires L' of an adjacent joint assembly, by feeding power cable 20E through the other horizontal power cable channel 42, through luminaire L corresponding to primary hinge 30, and then to one or more other luminaires L', or another joint assembly, connected to luminaire L. Alternatively, power to luminaires L of joint assembly 100 may not be supplied directly from the ceiling and vertical power cable channel 44, but rather through an adjacent joint assembly, or a luminaire L' of an adjacent joint assembly, fed directly to, or through luminaire L' connected to, luminaire L corresponding to primary hinge 30, and then through one of horizontal power cable channels 42 as alternate primary power cable 20E (in which case vertical power cable channel 44 may be used for a suspension cable only). Both of the foregoing embodiments are shown in FIGS. 11A to 11 E, 11G and 11H.

Figure 11I:
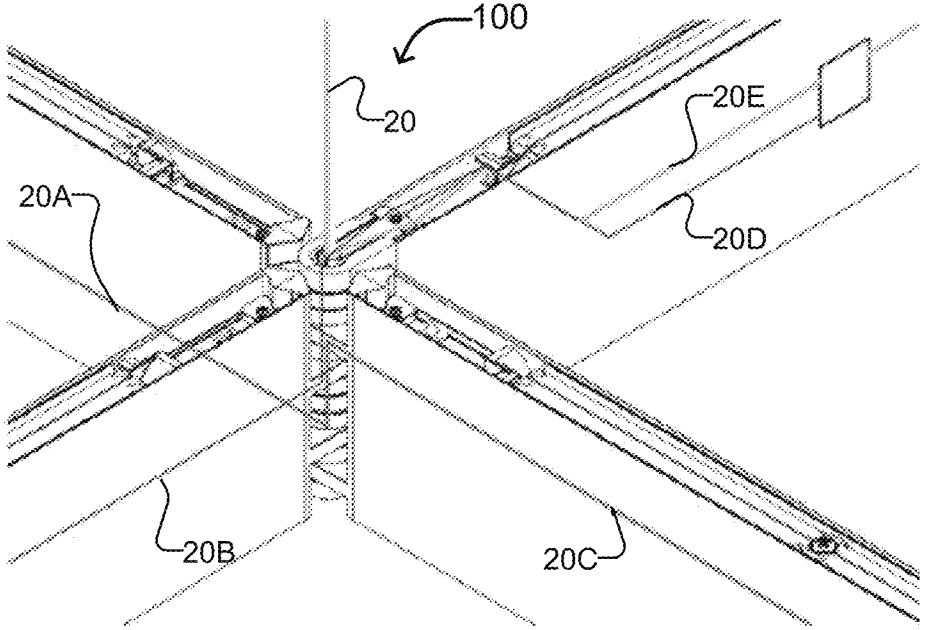
FIG. 11I is a partial upper perspective view of the joint assembly shown in FIG. 1A coupled to four luminaires, showing the power cables.
Figure 11J:
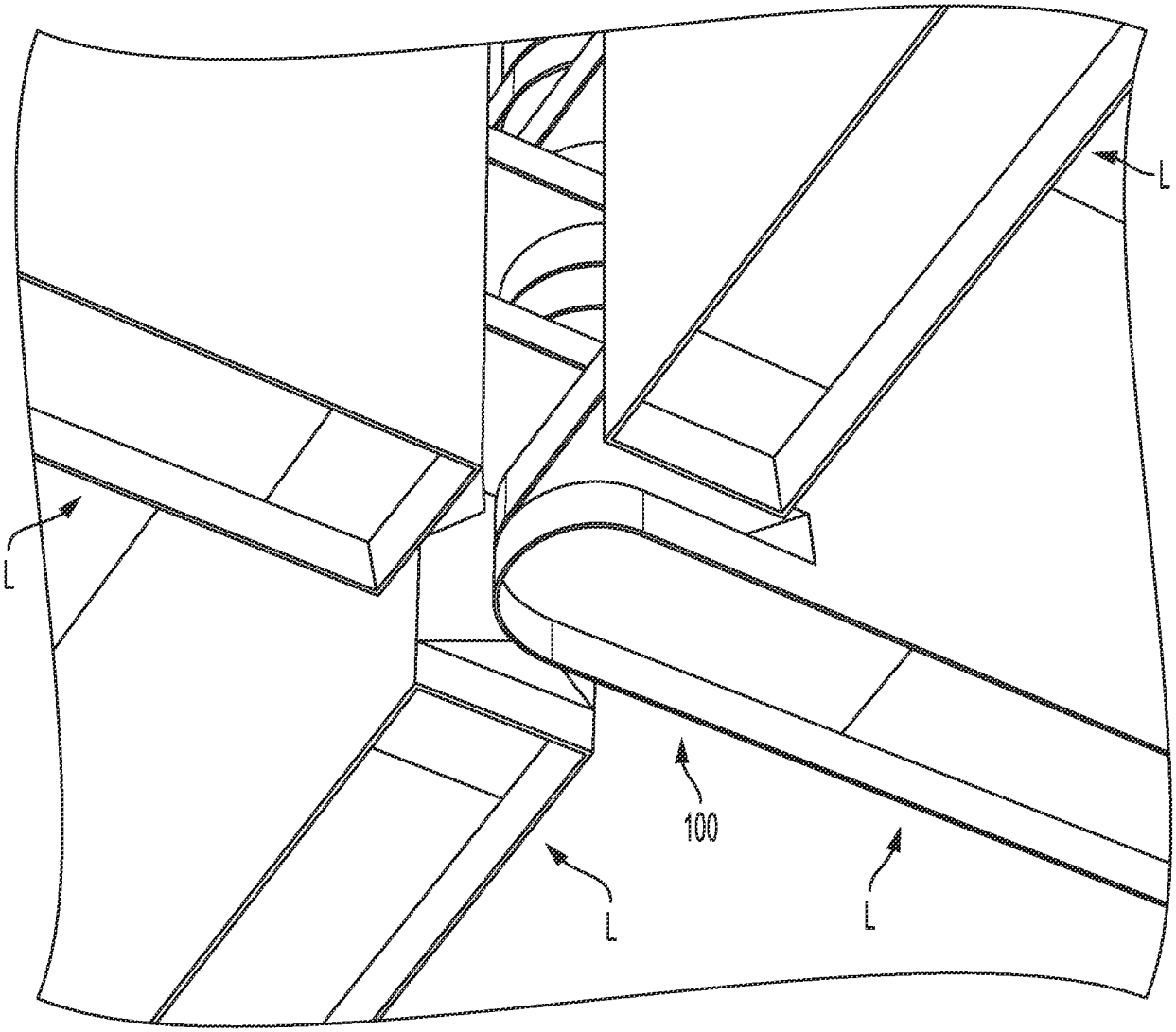
FIG. 11J is a partial lower perspective view of the joint assembly shown in FIG. 1A coupled to four luminaires.

FIG. 11I shows yet another possibility where the luminaires of joint assembly 100 are fed by different power sources. Primary power cable 20 from the ceiling splits into power cables 20B and 20D for power two opposing luminaires. Primary power cable 20 also splits into power cable 20E for powering luminaires connected to another joint assembly adjacent to the luminaire powered by power cable 20D. Power cables 20A and 20C are powered by a different power source, either from another joint assembly adjacent to the luminaire powered by power cable 20A or adjacent to the luminaire powered by power cable 20C.

Figure 5:
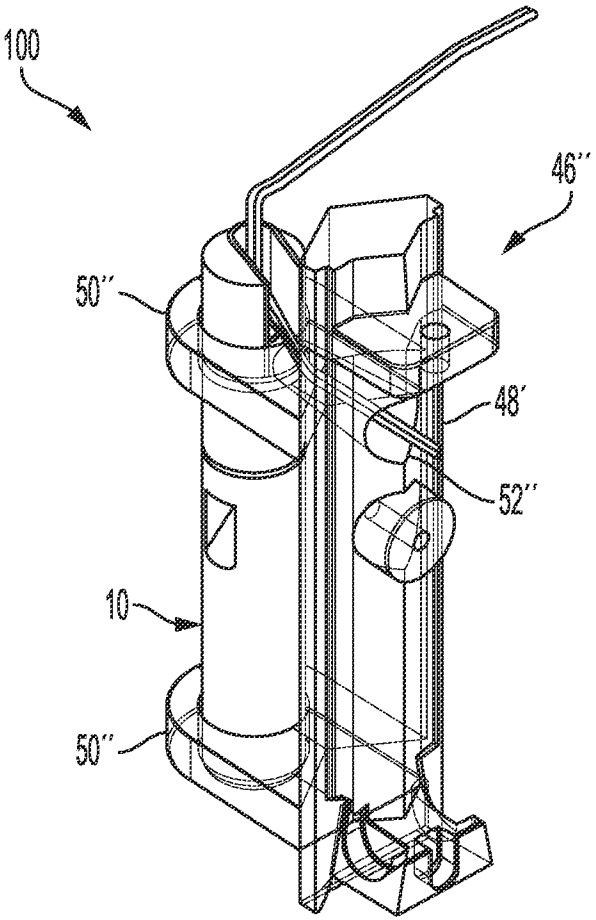
FIG. 5 is a partially transparent partial perspective view of the joint assembly shown in FIG. 1, showing a secondary hinge coupled to a pin.
Figure 4:
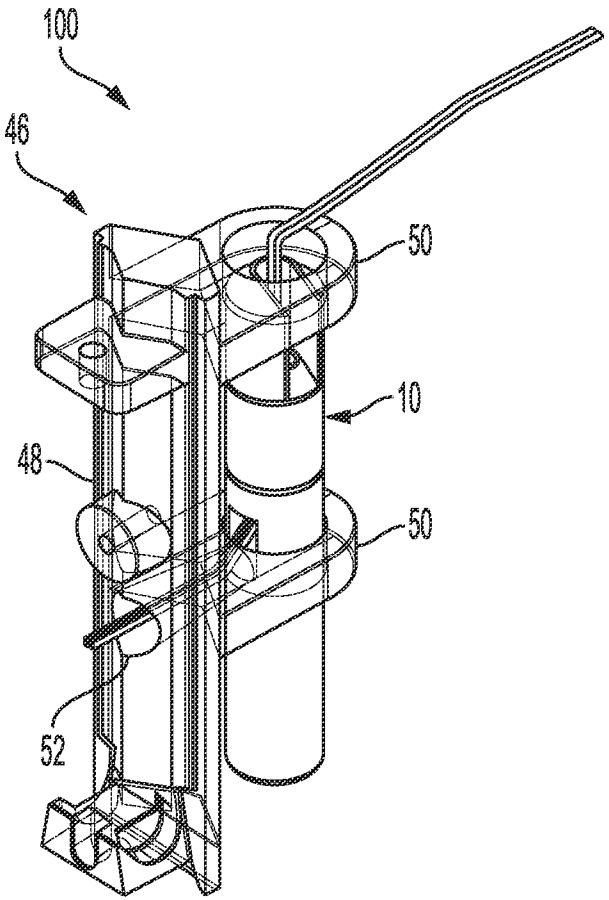
FIG. 4 is a partially transparent partial perspective view of the joint assembly shown in FIG. 1, showing a secondary hinge coupled to a pin.
Figure 6:
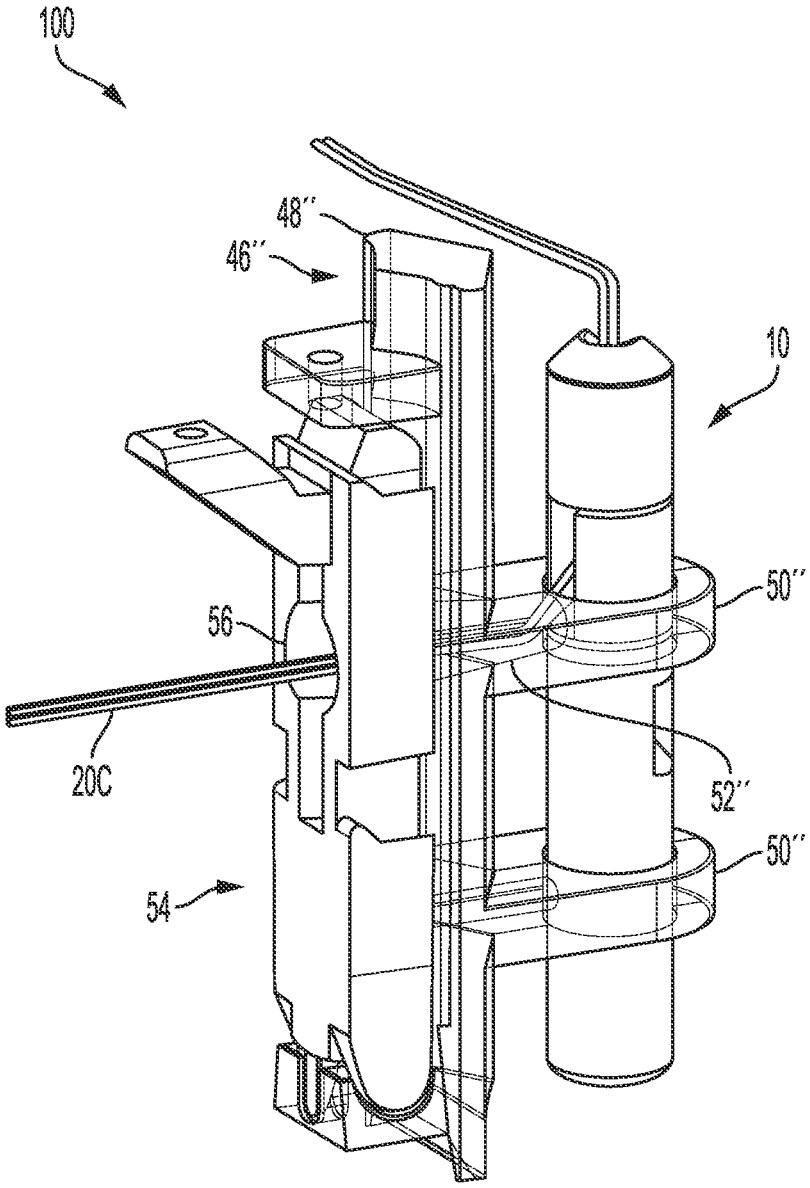
FIG. 6 is a partial perspective view of the joint assembly shown in FIG. 1, showing a luminaire attachment bracket coupled to a secondary hinge coupled to a pin.

FIGS. 4 to 6 show secondary hinges 46, 46', 46" of joint assembly 100. Secondary hinges 46, 46', 46" include a secondary vertical base 48, 48' and at least two secondary knuckles 50, 50', 50" extending generally perpendicularly from secondary vertical base 48, 48', 48". Secondary knuckles 50, 50', 50" are similar in features and functions to primary knuckles 34. Secondary knuckles 50, 50', 50" are spaced apart along secondary vertical base 48, 48', 48" such that each secondary knuckle 50, 50', 50" is positioned between primary knuckles 34 when coupled to pin 10, as shown for example in FIG. 7. In some embodiments secondary knuckles 50, 50', 50" may be positioned between primary knuckles 34 and/or secondary knuckles 50, 50' of a different secondary hinge 46, 46'.

Figure 7:
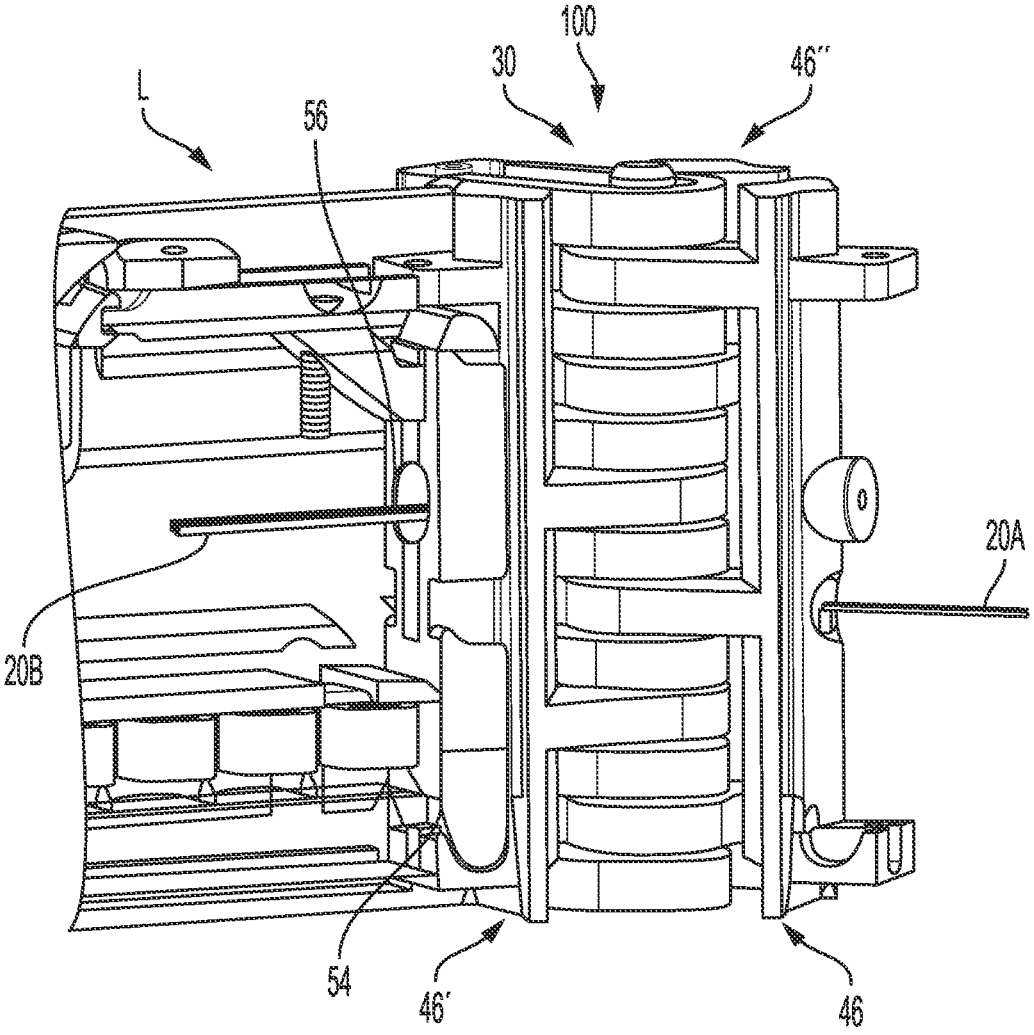
FIG. 7 is a perspective view of the joint assembly shown in FIG. 1 coupled to a luminaire, the luminaire shown in cutaway.

FIGS. 1 and 7 shows joint assembly 100 with primary hinge 30 and all three secondary hinges 46, 46', 46" coupled to pin 10 (obscured from view in FIGS. 5 and 7). Primary hinge 30 and secondary hinges 46, 46', 46" may engage pin 10 such that primary knuckles 34 and secondary knuckles 50, 50', 50" are interleaved. Each of secondary knuckles 50, 50', 50" is positioned between two primary knuckles 34 and within gaps 36 of primary hinge 30.

Referring to FIGS. 4 to 6, secondary hinges 46, 46', 46" include through-holes 52, 52', 52" disposed in secondary vertical base 48, 48', 48" for respective power cables 20A, 20B, 20C to pass through. Through-holes 52, 52', 52" are generally horizontally aligned with corresponding side openings 18, 28 of pin 10 where power cables 20A, 20B, 20C exit out of pin 10 to connect to corresponding luminaires L. In some embodiments through-holes 52, 52', 52" extend at least partially through corresponding secondary knuckles 50, 50', 50" and open at hole 38 of corresponding secondary knuckles 50, 50', 50" for receiving power cables 20A, 20B, 20C.

To connect luminaire L to joint assembly 100, an attachment mechanism such as a luminaire attachment bracket 54 as shown in FIG. 6 may be used. The distal face of primary hinge 30 or secondary hinge 46, 46', 46" may be adapted to engage bracket 54 for coupling a luminaire L to hinge, as shown in FIG. 1. Bracket 54 may have a through-hole 56 for power cable 20A, 20B, 20C to pass through and power corresponding luminaire L. When bracket 54 is coupled to a secondary hinge 46, 46', 46", through-hole 56 is aligned with through-hole 52, 52', 52" for power cable 20A, 20B, 20C to pass from pin 10 to corresponding luminaire L.

Once assembled, primary hinge 30 and secondary hinges 46, 46', 46" may be rotated rotate about pin 10 to adjust the orientation of luminaires L coupled to joint assembly 100. Such adjustments may be made before, during and/or after installation. For example, joint assembly 100 connects four luminaires L in a cross-shaped arrangement. Side opening 18 of base section 12 and side openings 28 of the two secondary sections 22 may each initially be configured at 90, 180 and 270 degrees from the direction of horizontal power cable channel 42 of primary hinge 30 by suitably rotating base section 12 and secondary sections 22 in relation to primary hinge 30.

During connection of luminaires L and/or during other steps of installation, base section 12 and/or secondary sections 22 may inadvertently rotate, resulting in a misalignment from their desired positions. In such cases the hinges or the luminaires L themselves may be manually rotated into the desired position, and any significant misalignment of base section 12 and/or secondary sections 22 will be corrected by abutment of the power cable against side openings 18, 28 and the distal opening of through-holes 52, 52', 52" as the hinges or luminaires are rotated (see FIGS. 4 to 6).

Figure 8H:
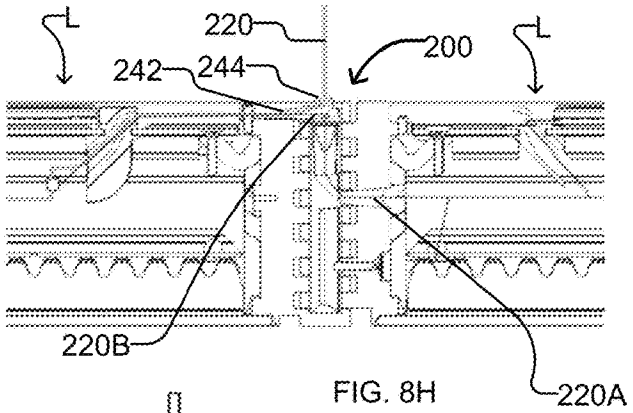
FIG. 8H is a partial vertical cross-sectional view of the joint assembly shown in FIG. 8A coupled to two luminaires.
Figure 8F:
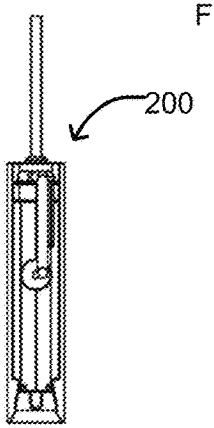
FIGS. 8D, 8E, 8F, and 8G are respectively top, side, bottom and front views of the joint assembly shown in FIG. 8A.
Figure 8D:
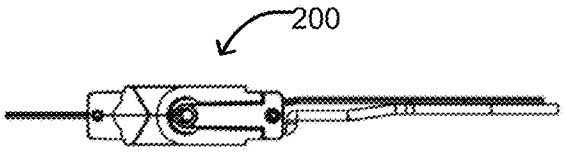
Figure 8E:
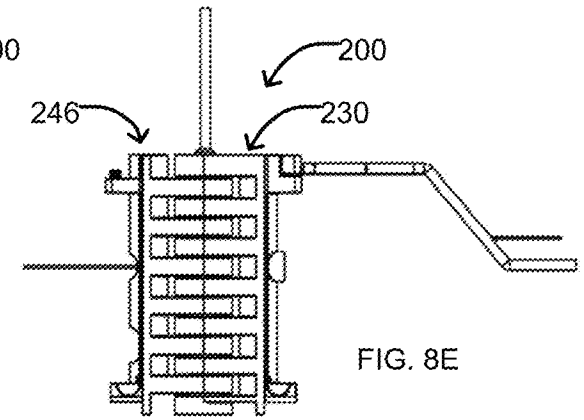
Figure 8G:
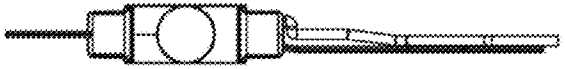
Figure 8A:
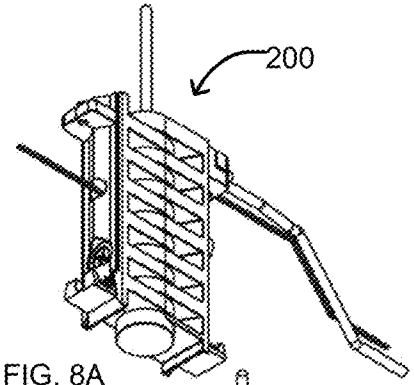
FIG. 8A is a lower perspective view of a joint assembly according to an embodiment in a linear configuration.
Figure 8B:
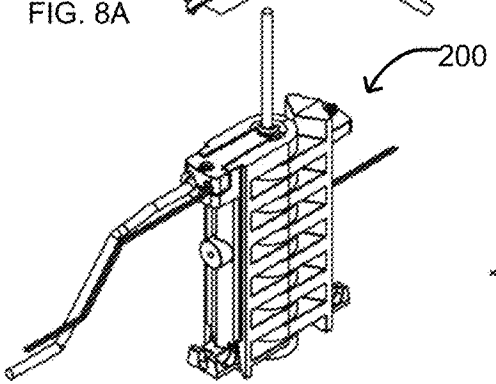
FIG. 8B is an upper perspective view of the joint assembly shown in FIG. 8A.
Figure 8C:
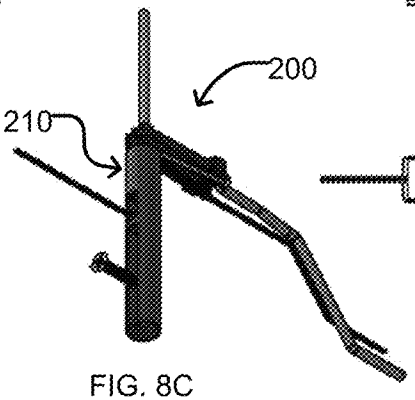
FIG. 8C is a partial lower perspective view of the joint assembly shown in FIG. 8A, showing a pin.
Figure 9A:
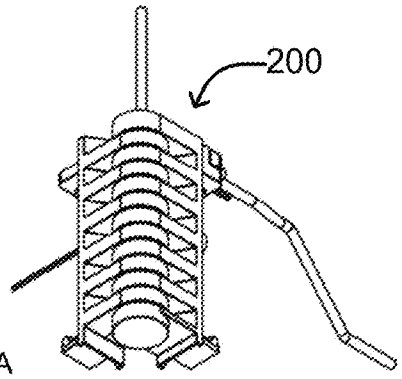
FIG. 9A is a lower perspective view of the embodiment shown in FIG. 8A in a perpendicular configuration.
Figure 9B:
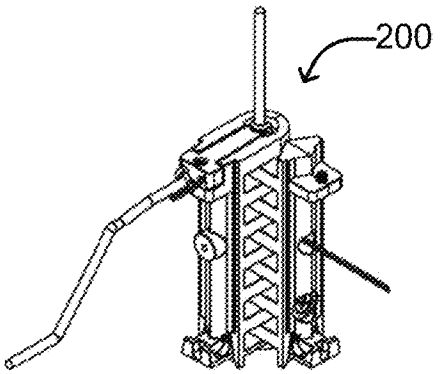
FIG. 9B is an upper perspective view of the joint assembly shown in FIG. 9A.
Figure 9C:
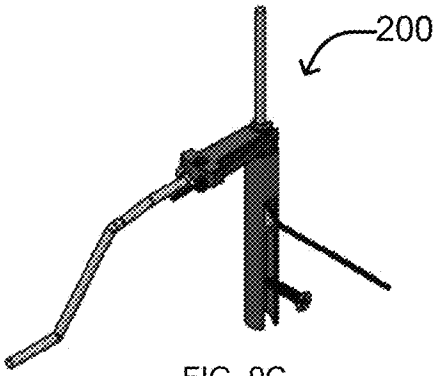
FIG. 9C is a partial lower perspective view of the joint assembly shown in FIG. 9A, showing a pin and a cord suspension slider.
Figure 9D:
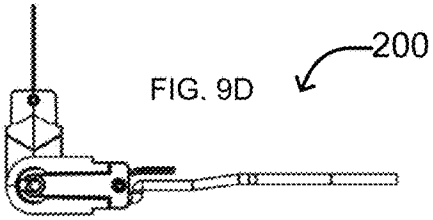
FIGS. 9D, 9E, 9F, and 9G are respectively top, side, front and bottom views of the joint assembly shown in FIG. 9A.
Figure 9E:
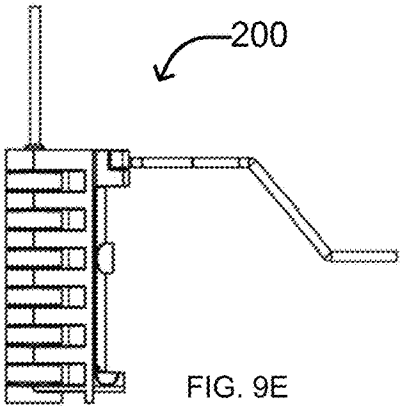
Figure 9F:
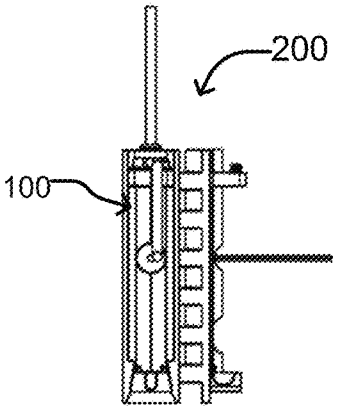
Figure 9G:
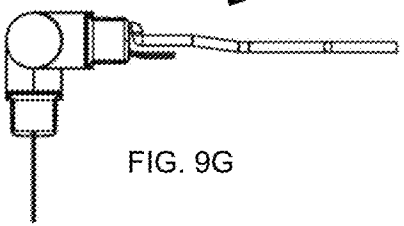
Figure 10A:
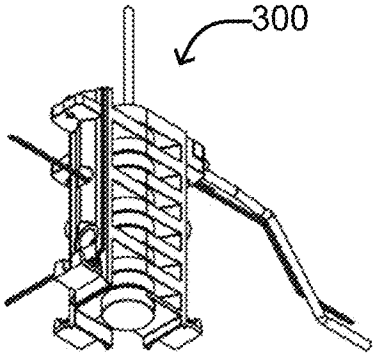
FIG. 10A is a lower perspective view of a joint assembly according to an embodiment.
Figure 10B:
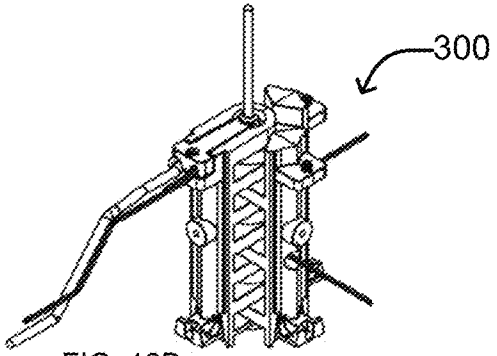
FIG. 10B is an upper perspective view of the joint assembly shown in FIG. 10A.
Figure 10C:
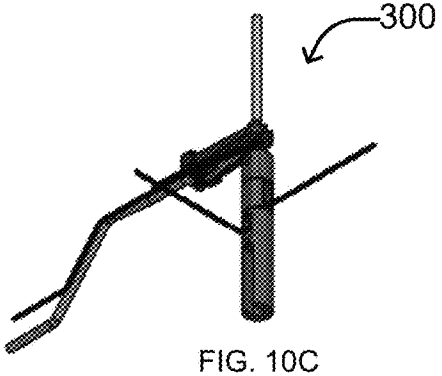
FIG. 10C is a partial lower perspective view of the joint assembly shown in FIG. 10A, showing a pin.
Figure 10D:
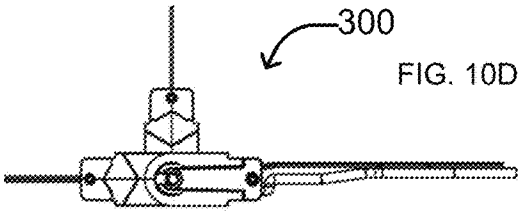
FIGS. 10D, 10E, 10F, and 10G are respectively top, side, front and bottom views of the joint assembly shown in FIG. 10A.
Figure 10E:
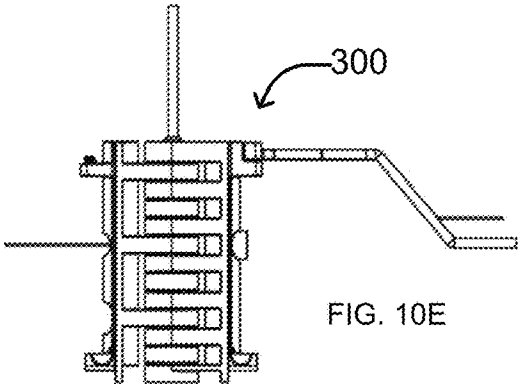
Figure 10F:
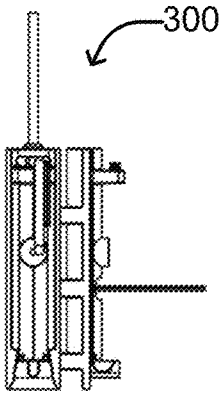
Figure 10G:
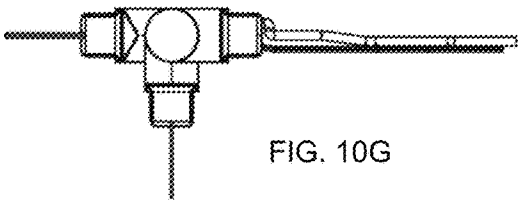

FIGS. 8A-8H shows a joint assembly 200 according to another embodiment. Joint assembly 200 has functions and features similar to joint assembly 100 except it has one secondary hinge instead of three secondary hinges. Joint assembly 200 includes a pin 210, primary hinge 230 and one secondary hinge 246 to support two luminaires L. One luminaire L is coupled to primary hinge 230, and another luminaire L is coupled to secondary hinge 246. As illustrated in FIGS. 8A-8H, primary and secondary hinges 230, 246 are shown oriented and aligned in the same vertical plane. The luminaires are therefore also aligned in the same vertical plane, positioned on either side of pin 210, as shown in FIG. 8H. In some embodiments primary hinge 230 and/or secondary hinge 246 may be rotatable, allowing the luminaires to be at any desirable angle with respect to each other. For example, FIGS. 9A to 9G show joint assembly 200 with the hinges, and therefore the luminaires, configured in a perpendicular position to each other.

Referring to FIG. 8H, a primary power cable 220 may be supplied from the ceiling and split off into power cable 220B which connects to luminaire L connected to primary hinge 230 by passing through vertical power cable channel 244 and one of the horizontal power cable channels 242 located at an upper portion of primary hinge 230. Primary power cable 220 may also be fed through the other horizontal power cable channel 242 to connect to an adjacent luminaire L' (not shown) through luminaire L. Primary power cable 220 also splits off into power cable 220A to power luminaire L coupled to secondary hinge 246. Power cable 220B passes through pin 210 (i.e. through a top opening, bore, and out a side opening) to connect to luminaire L.

FIGS. 10A to 10G show a joint assembly 300 according to another embodiment. Joint assembly 300 is similar in function and features to joint assemblies 100 and 200 except joint assembly 300 has three hinges, i.e., a primary hinge and two secondary hinges, to connect three luminaires L. The three hinges may for example be oriented to form a generally T-shape. The three hinges may be further adjusted by rotating/pivoting around the pin to form other patterns/orientations with three luminaires (e.g. a Y-shape, etc.).

Figure 12A:
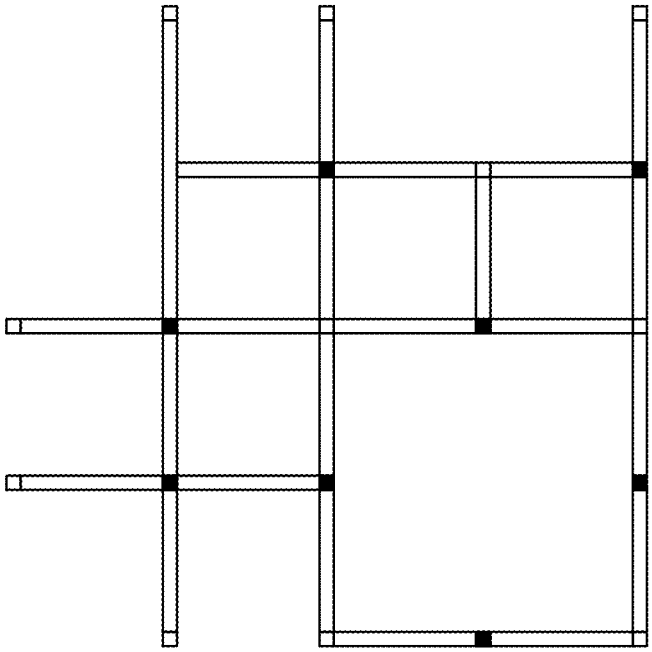
FIGS. 12A, 12B and 12C are arrangements of joint assemblies and luminaires according to example embodiments.
Figure 12B:
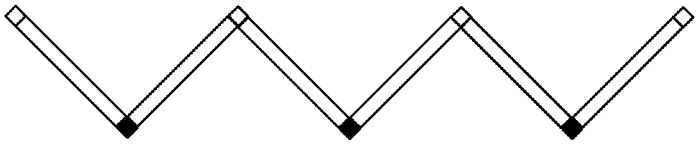
Figure 12C:
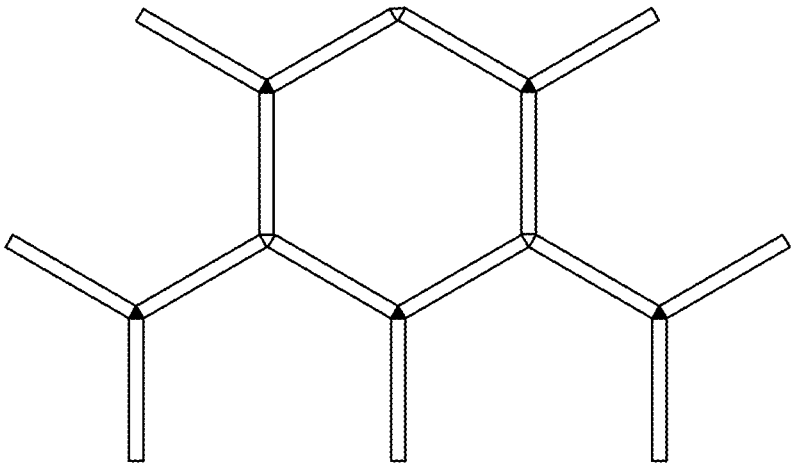

FIGS. 12A to 12C show example embodiments of arrangements of luminaires using joint assemblies of the present invention. The filled in squares and triangles represent joint assemblies where a power cable from the ceiling is used for suspension, and the empty squares and triangles represent joint assemblies with only a suspension cable from the ceiling (i.e., no power cable).

While a number of exemplary aspects and embodiments have been discussed above, those of skill in the art will recognize certain modifications, permutations, additions and sub-combinations thereof. For example:

The knuckles of the hinges may engage the pin by any suitable means that permit rotation of the hinges about the pin. For example, instead of a hole, the distal portion of the knuckle may be formed as C-shaped clasps.

The pin may be formed as a single integral component instead of as multiple sections. The pin would still have the desired number of side openings in the desired orientations. The primary hinge and one or more secondary hinges may all have the same numbers of knuckles The secondary hinges may each have different numbers of knuckles.

The pin may be shaped other than cylindrically, for example with a square or other polygonal horizontal cross-section, with correspondingly shaped holes in the distal portion of the knuckles. The base and secondary sections may be rotatable as between each other to allow adjustment of the orientation of the luminaires.

A joint assembly may connect more luminaires than described herein. In some embodiments the joint assembly may connect five or more luminaires, with a corresponding number of hinges. For example, a joint assembly connecting five luminaires may require a pin with one base section and three secondary sections.

The luminaires connected by the joint assembly may be the same or different. In some embodiments the hinges of the same joint assembly may connect to luminaires of similar design but different dimensions. In some embodiments the hinges of the same joint assembly may connect to luminaires of different designs.

The attachment mechanism between the hinge and the attachment bracket may be universal so that brackets designed for different luminaires may attach to the joint assembly. In some embodiments the bracket and hinge may be formed as an integral component.

The base section and secondary sections of the pin may manufactured such that they are fixed relative to each other in a configuration resulting in a pre-determined desired arrangement of luminaries.

Figure 13:
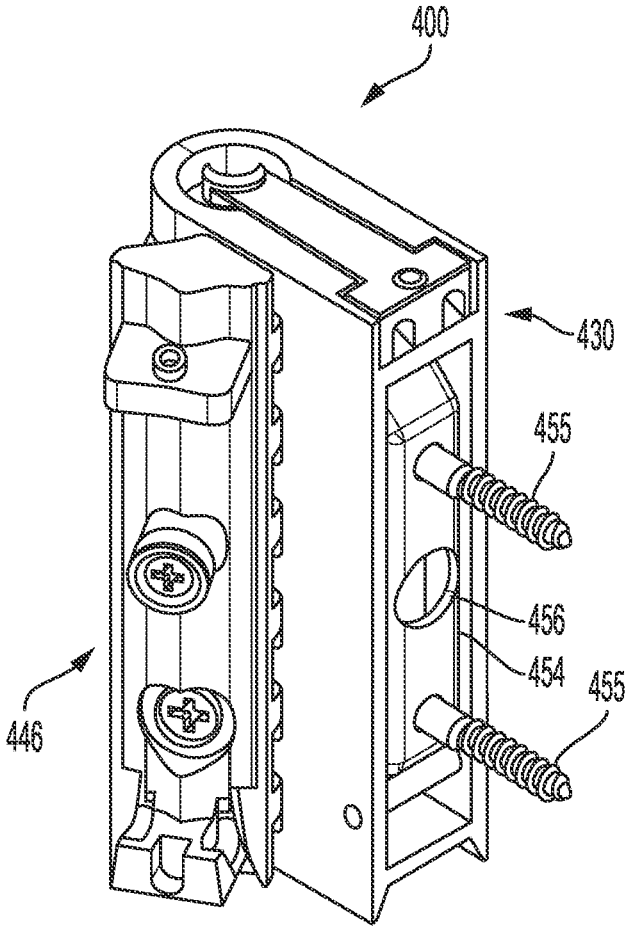
FIG. 13 is a perspective view of a joint assembly according to another embodiment.

Instead of, or in addition to being, suspended, the joint assembly may be fixed to a wall or other structure. FIG. 13 shows a joint assembly 400 according to another embodiment where a primary hinge 430 comprises a bracket 454 with a plurality of fasteners 455 for fixing to a wall (not shown). Bracket 454 has a through-hole 456 through which a primary power cable from the wall may be extended to power the luminaire (not shown) connected to a secondary hinge 446. In other embodiments the joint assembly may connect to two or more secondary hinges for connection to two or more luminaires.

It is therefore intended that the following appended claims and claims hereafter introduced are interpreted to include all such modifications, permutations, additions and sub-combinations as are consistent with the broadest interpretation of the specification as a whole.

The invention claimed is:

1. A joint assembly for luminaires, comprising:

a pin comprising at least one pin section, each pin section comprising:

an upper opening;

a side opening;

a bore connecting the upper opening and the side opening;

wherein the upper opening is configured to receive at least one power cable to feed through the bore and out the side opening;

a primary hinge comprising:

a primary vertical base for connecting to a luminaire or wall;

a plurality of primary knuckles extending from the vertical base, wherein a distal portion of the knuckles comprises pin engagement means; and at least one secondary hinge comprising:

a secondary vertical base for connecting to an additional luminaire;

a plurality of secondary knuckles extending from the vertical base, wherein a distal portion of the knuckles comprises pin engagement means for engaging the pin.

2. A joint assembly according to claim 1 wherein the primary hinge, the at least one secondary hinge, or both, are rotatably coupled to the pin.

3. A joint assembly according to claim 1 wherein the primary knuckles and secondary knuckles interleave.

4. A joint assembly according to claim 1 wherein the side openings of the pin section horizontally align with gaps between the plurality of primary knuckles.

5. A joint assembly according to claim 1 wherein the at least one secondary hinge comprises a through-hole extending through the secondary vertical base to receive the at least one power cable from a corresponding side opening of the pin to feed to a luminaire connectable to the at least one secondary hinge.

6. A joint assembly according to claim 5 wherein the through-hole and the corresponding side opening are horizontally aligned.

7. A joint assembly according to claim 6 wherein the through-hole extends at least partially through at least one of the plurality of secondary knuckles.

8. A joint assembly according to claim 7 wherein the through-hole opens at the hole of the at least one of the plurality of secondary knuckles.

9. A joint assembly according to claim 1 wherein an upper portion of the primary hinge comprises at least one vertical power cable channel and at least one horizontal power cable channel.

10. A joint assembly according to claim 9 wherein the upper portion comprises two horizontal power cable channels.

11. A joint assembly according to claim 1 wherein the side opening comprises a outwardly and downwardly tapered lower surface.

12. A joint assembly according to claim 1 wherein the pin comprises two or more pin sections, wherein the pin sections are stacked to define the pin.

13. A joint assembly according to claim 1 wherein pin sections are rotatable with respect to each other.

14. A joint assembly according to claim 1 wherein the pin is cylindrical.

15. A joint assembly according to claim 1 wherein each of the primary hinge and the at least one secondary hinges comprises a bracket for connecting the primary and secondary vertical bases to corresponding luminaires.

16. A joint assembly according to claim 1 wherein the pin engagement means comprises a hole in the distal portion of the knuckles.

17. A joint assembly according to claim 1 comprising one, two or three secondary hinges.

* * * * *